US005228240A

United States Patent [19]

Barroero et al.

[11] Patent Number: 5,228,240

[45] Date of Patent: Jul. 20, 1993

[54] REFRIGERATOR DOOR ASSEMBLY AND METHOD

[75] Inventors: Louis Barroero, San Leandro; John P. Rivers, Livermore, both of Calif.

[73] Assignee: 2420 Door Co., Alameda, Calif.

[21] Appl. No.: 826,883

[22] Filed: Jan. 28, 1992

[51] Int. Cl.[5] ..... E05F 1/10

[52] U.S. Cl. ..... 49/386; 49/478; 49/489.1; 49/DIG. 2; 16/308

[58] Field of Search ..... 49/381, 386, 387, 388, 49/501, 478, 489, DIG. 2; 16/308

[56] References Cited

U.S. PATENT DOCUMENTS

| | | | |
|---|---|---|---|
| 3,091,819 | 6/1963 | Wheeler et al. | 49/386 |
| 3,124,848 | 3/1964 | Wheeler et al. | 49/386 |
| 3,331,159 | 7/1967 | Cooke et al. | 49/388 |
| 3,507,074 | 4/1970 | Gallegos . | |
| 3,510,986 | 5/1970 | Berkowitz | 49/386 |
| 3,882,637 | 5/1975 | Lindenschmidt | 49/501 |
| 4,084,347 | 4/1978 | Brown | 49/488 |
| 4,413,446 | 11/1983 | Dittrich | 49/478 |
| 4,416,086 | 11/1983 | Niekrasz | 49/388 |
| 4,478,003 | 10/1984 | Fleh | 49/501 |
| 4,637,167 | 1/1987 | Svensson | 49/386 |
| 4,646,472 | 3/1987 | Sugawara | 49/386 |
| 4,891,912 | 1/1990 | Bockwinkel | 49/478 |

FOREIGN PATENT DOCUMENTS

| | | | |
|---|---|---|---|
| 580944 | 8/1959 | Canada | 49/386 |

*Primary Examiner*—Peter M. Cuomo
*Assistant Examiner*—Michael Milano
*Attorney, Agent, or Firm*—Phillips, Moore, Lempio & Finley

[57] ABSTRACT

A refrigerator door assembly is mounted on a stationary frame of a refrigeration unit and comprises a door frame integrally molded about a thermo-pane in sealing relationship therewith. The door frame is hingedly mounted on the stationary frame of the refrigeration unit by a pair of upper and lower hinge pins. A torsion bar, integrally molded within the door frame and secured to one of the hinge pins, functions to constantly apply a closing force on the door frame to move the door assembly into sealing contact with the stationary frame of the refrigeration unit.

15 Claims, 3 Drawing Sheets

REFRIGERATOR DOOR ASSEMBLY AND METHOD

TECHNICAL FIELD

This invention relates generally to a refrigeration unit and more particularly to a unitized refrigerator door assembly therefor.

BACKGROUND OF THE INVENTION

Conventional window-type door assemblies for refrigeration units of the type used in supermarkets and the like comprise a frame having a thermo-pane mounted therein. The frame is composed of extruded aluminum frame members secured together by corner brackets. The thermo-pane normally comprises a pair of glass plates suitably spaced apart by spacer members disposed about the peripheries of the plates. An elastomeric gasket is secured between the frame and the edges of the plates in a conventional manner.

Standard door assemblies of this type are expensive to fabricate and assemble due to the large number of component parts involved and the labor intensive steps required for the assembly process. Further, a relatively high thermal conductivity is exhibited by the aluminum frame that induces undue conduction of heat within the refrigeration unit. In addition, an electrical heating system is normally required to prevent condensation on the glass plates composing the thermo-pane. The door assemblies also normally require the consumer-customer to close them manually, after it they have been opened for product procuring purposes.

SUMMARY OF THE INVENTION

An object to this invention is to overcome the above, briefly described problems encountered with conventional door assemblies for refrigeration units by providing an economical refrigerator door assembly that exhibits a high degree of structural integrity and efficiency when placed in operation.

In one aspect of this invention, the refrigerator door assembly comprises a door frame and vertically aligned upper and lower hinge pins integrally molded within the door frame for mounting the door assembly for pivotal movement about a common pivot axis on a stationary frame of a refrigeration unit.

In another aspect of this invention, a torsion bar is molded as an integral part of the door frame and functions to constantly apply a closing force on the door assembly.

In still another aspect of this invention, a method for making the refrigerator door assembly is taught which includes injecting a liquified thermo plastic or thermosetting plastic material into a mold cavity to form the door frame and curing and hardening the plastic material to form a structurally integrated refrigerator door assembly.

BRIEF DESCRIPTION OF THE DRAWINGS

Other objects and advantages of this invention will become apparent from the following description and accompanying drawings wherein.

DESCRIPTION OF THE PREFERRED EMBODIMENT

Figure 1:
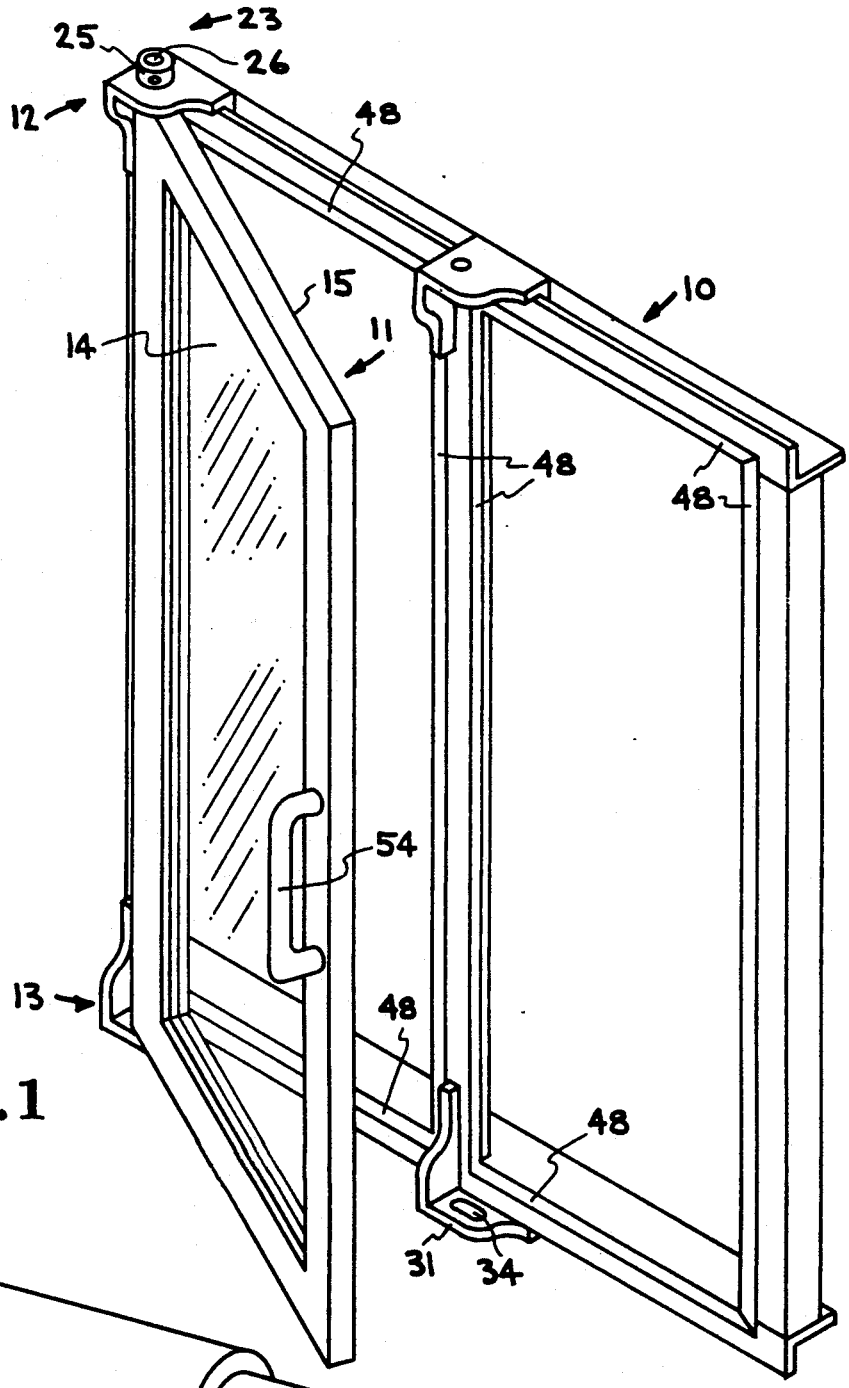
FIG. 1 is an isometric view illustrating a mounting frame for a refrigeration unit having a refrigerator door assembly of this invention hingedly mounted thereon.
Figure 2:
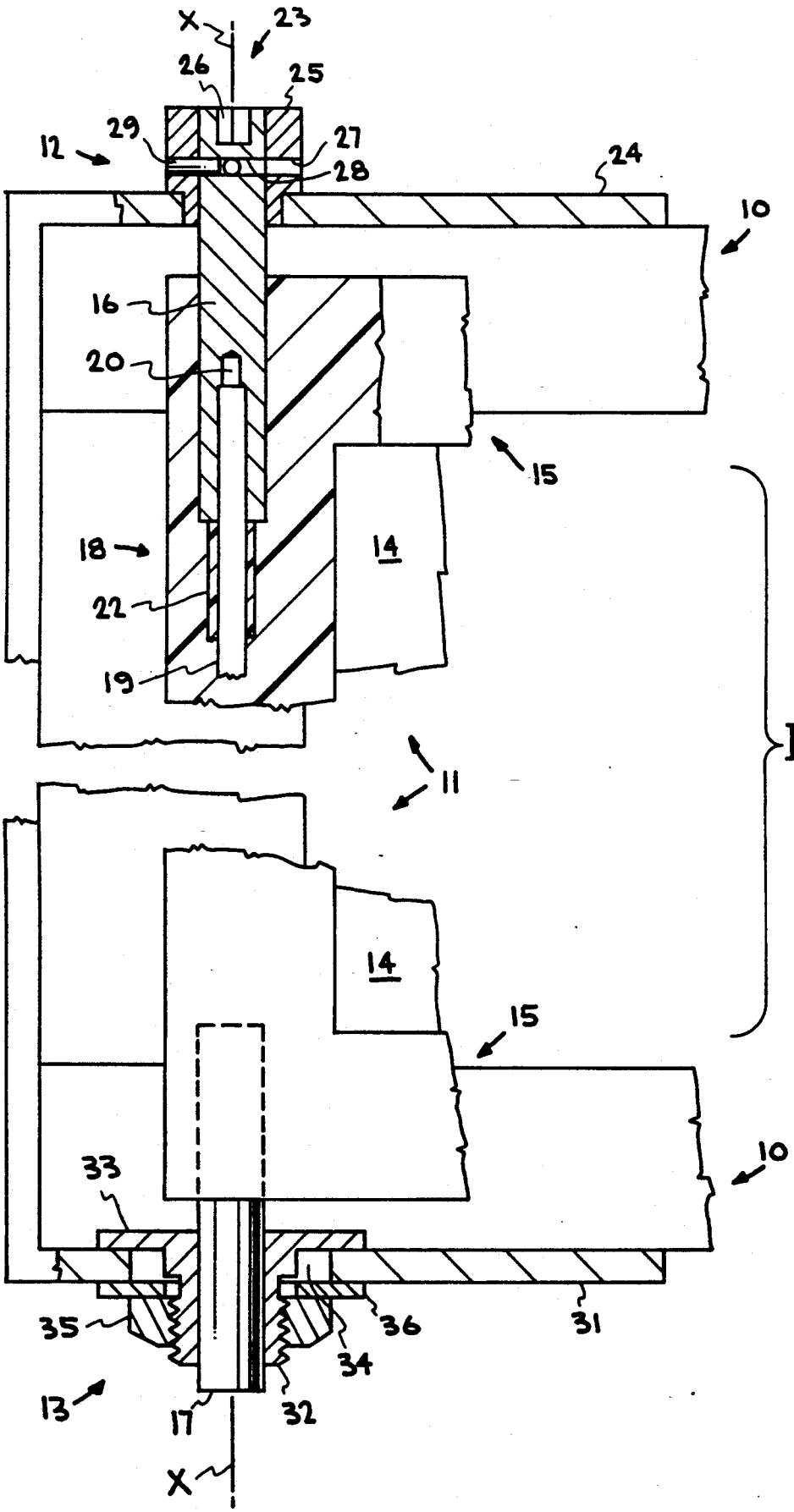
FIG. 2 is a partially sectioned, enlarged view illustrating upper and lower hinge assemblies mounting the refrigerator door assembly on the frame of the refrigeration unit.

FIG. 1 illustrates a stationary metallic mounting frame 10 of a refrigeration unit (not fully shown) of the commercial or domestic type. A refrigerator door assembly 11 is hingedly mounted on frame 10 by upper and lower hinge assemblies 12 and 13, respectively, for pivotal movement about a common pivot axis X (FIG. 2). As described more fully hereinafter, a second refrigerator door assembly is adapted to be hingedly mounted on the opposite side of frame 10 in a conventional manner. As will be obvious to those skilled in the refrigeration arts, the frame can be constructed in accordance with the teachings of this invention to mount one, two or more left and/or right handed (FIG. 1) door assemblies thereon, depending on the particular commercial or domestic application under consideration.

Each door assembly 11 comprises a transparent thermo-pane 14 having a door frame 15 integrally molded thereabout and in sealing relationship therewith, as described more fully hereinafter with reference to FIGS. 4 and 5. As shown in FIG. 2, upper and lower hinge assemblies 12 and 13 comprise vertically aligned upper and lower hinge pins 16 and 17, respectively. A torsion means 18 (FIG. 3) is connected to at least one of the upper and lower hinge pins for constantly applying a closing force F (FIG. 1) on door frame 15 to pivot the refrigerator door assembly towards its normal, closed position on mounting frame 10.

Figure 3:
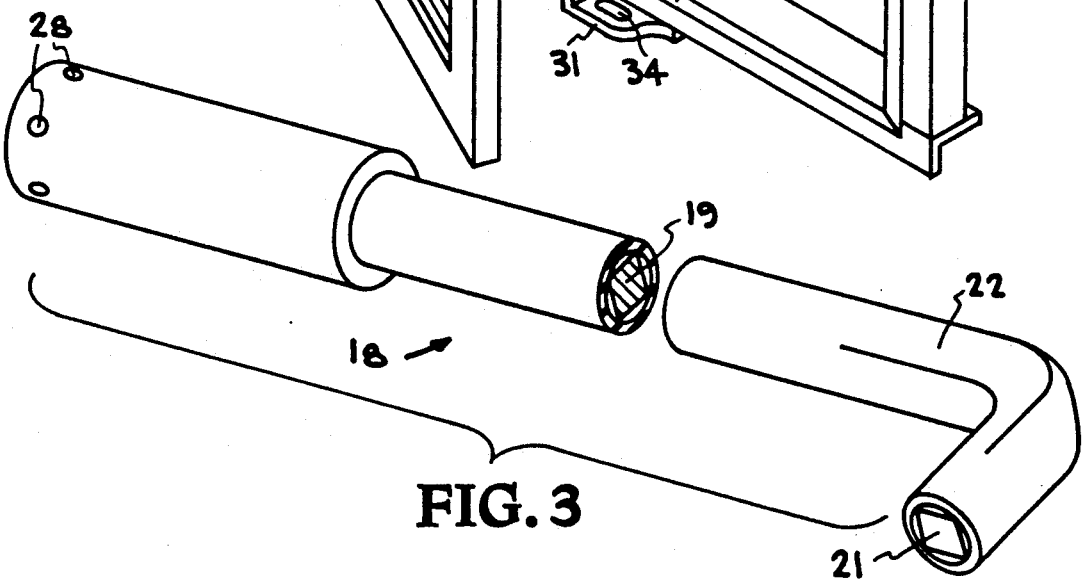
FIG. 3 is an isometric view illustrating a combined hinge pin and adjustable torsion bar that is molded and structurally integrated within a door frame of the refrigerator door assembly.
Figure 4:
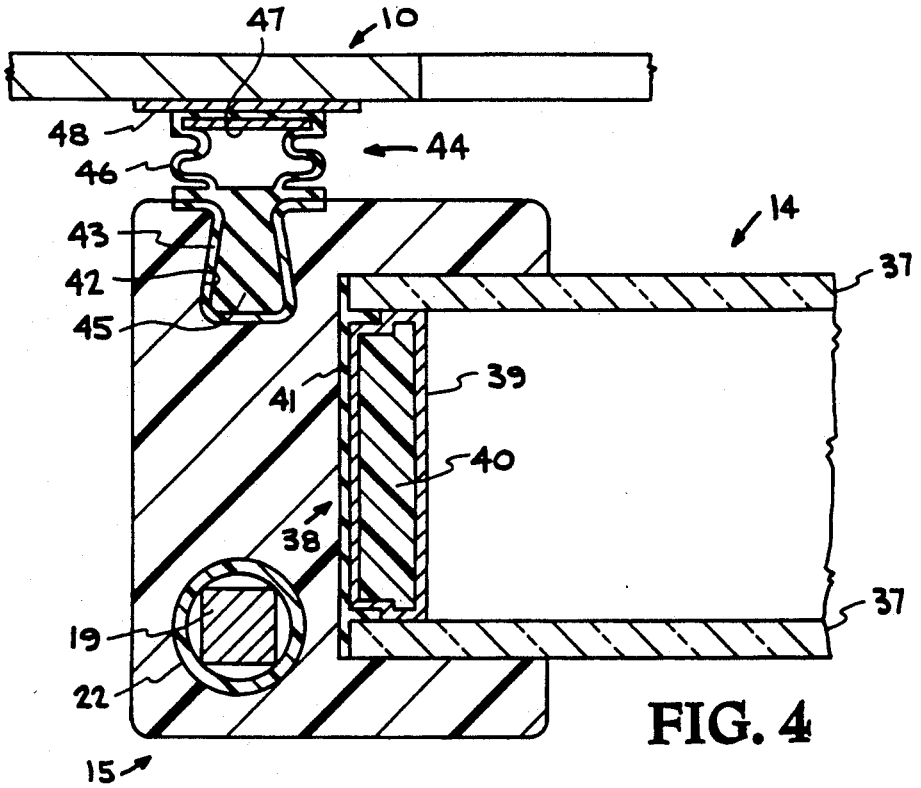
FIG. 4 is an enlarged sectional view partially illustrating the sealed disposition of a thermo-pane and torsion bar in the door frame and a static magnetic seal between the frame of the refrigeration unit and the door frame when the refrigerator door assembly is in its closed position.

As shown in FIGS. 2–4, the torsion means is molded within the door frame to be structurally integrated therewith and comprises a steel torsion bar 19. As shown in FIG. 2, the upper end of upper hinge pin 16 projects beyond an upper end of door frame 15 and an upper end of torsion bar 19 is secured to a lower end of pin 16. As shown in FIGS. 3 and 4, torsion bar 19 preferably has a square cross-section and an outer dimension slightly larger than a bore 20, preformed in pin 16 prior to the force-fitting or swaging of the torsion bar into the bore. In particular, the torsion bar is forced into the bore to plastically deform the contacting metal surfaces whereby the torsion bar and pin will be secured together for simultaneous rotation and twisting.

As shown in FIG. 2, a main body of torsion bar 19 is disposed on common pivot axis X of pins 16 and 17 and a lower end 21 of the torsion bar is bent to provide an anchoring leg 21 (FIG. 3) embedded in the door frame and disposed transversely relative to the axis. The dimensional parameters of the torsion bar, including its length and the location along the vertical height of door assembly 11 whereat anchoring leg 21 of the torsion ba is located (e.g., one-fourth of the length of the door assembly), as well as its composition, will be primarily dictated by the size and mass of the door assembly requiring a particular automatic closing force. As further shown in FIGS. 2 and 3, the torsion bar is preferably covered with a plastic sheath 22 to permit the torsion bar to twist within the sheath and relative to encapsulating door frame 15.

During the hereinafter described molding process, upper hinge pin 16 is preferably coated with a standard release agent to prevent the steel pin from adhering to the surrounding plastic material composing door frame 15. An adjustment means 23 is provided between upper hinge pin 16 and an upper hinge bracket 24, seamed to frame 10, of upper hinge assembly 12 for manually and selectively setting the magnitude of closing force F (FIG. 1) imposed on the door assembly. In the embodiment illustrated, adjustment means 23 comprises a collar 25 mounted on the upper end of hinge pin 16 and welded or otherwise suitably secured to upper hinge bracket 24.

A hexagonal socket 26 is formed in the proximal or upper end of pin 16 to adapt it for reception of a standard Allen head wrench whereby the pin can be rotated to selectively adjust the closing force imposed on the door assembly by torsion bar 19. A plurality of circumferentially spaced and radially extending bores 27 are formed in collar 25 for alignment with a plurality of like-formed bores 28, formed in the upper end of pin 16, for the reception of a locking pin 29 (FIG. 2). The bores and locking pin thus provide means for locking hinge pin 16 in a selected rotative position relative to collar 25 when the pin is rotated to impose the desired closing force on the door assembly.

As shown in FIG. 2, lower hinge assembly 13 comprises a lower hinge bracket 31 suitably secured on stationary mounting frame 10 to have the lower end of lower hinge pin 17 pivotally mounted thereon. The upper end of pin 17 is suitably secured within molded door frame 15. The pin is rotatably mounted within an externally threaded first nut 32 having an upper flange 33 overlying lower hinge bracket 31. The nut extends through an elongated slot 34, formed through bracket 31, and is secured in place by an internally threaded second nut 35 and a lock washer 36. Thus, means are provided for securing lower hinge pin 17 in an adjusted side-to-side position within slot 34 for vertically orientating common pivot axis X for vertically aligned pins 16 and 17, e.g., to adjust for "door sag."

As shown in FIG. 4, thermo-pane 14 comprises a pair of spaced-apart window panes or glass plates 37, preferably tempered and pre-treated in a conventional manner for refrigerator door applications. A sealing strip 38 is disposed between and about the periphery of the glass plates and is integrally molded within door frame 15. The sealing strip comprises a metallic spacer 39 that encapsulates a silica gel material 40 and an elastomeric (natural or synthetic rubber) gasket 41 covering the outer edges of the sealing strip and glass plates. The space between glass plates 37 can be evacuated or filled with an inert thermal insulating gas, as is well-known to those skilled in the art.

A groove 42 is formed in an inner side of door frame 15 to extend about the frame and has an elastomeric gasket 43 preformed therein. A magnetic strip and seal means 44 is press-fit and secured in groove 42 for maintaining the refrigerator door assembly in closed and sealed relationship on stationary mounting frame 10. The magnetic strip and seal means comprises an elastomeric member, including a generally U-shaped anchoring stem 45 compressed within groove 42 and a bellows-type elastomeric gasket 46 having a magnetic strip 47 secured therein. A metallic tape 48 in strip-form is suitably secured on the outer face of mounting frame 10 (FIGS. 1 and 4) to cooperate with magnetic strip 47 to hold the refrigerator door assembly in sealing relationship on the frame when the door assembly is moved automatically, by the force imposed thereon by torsion rod 19, to its normally closed position on frame 10.

Figure 5:
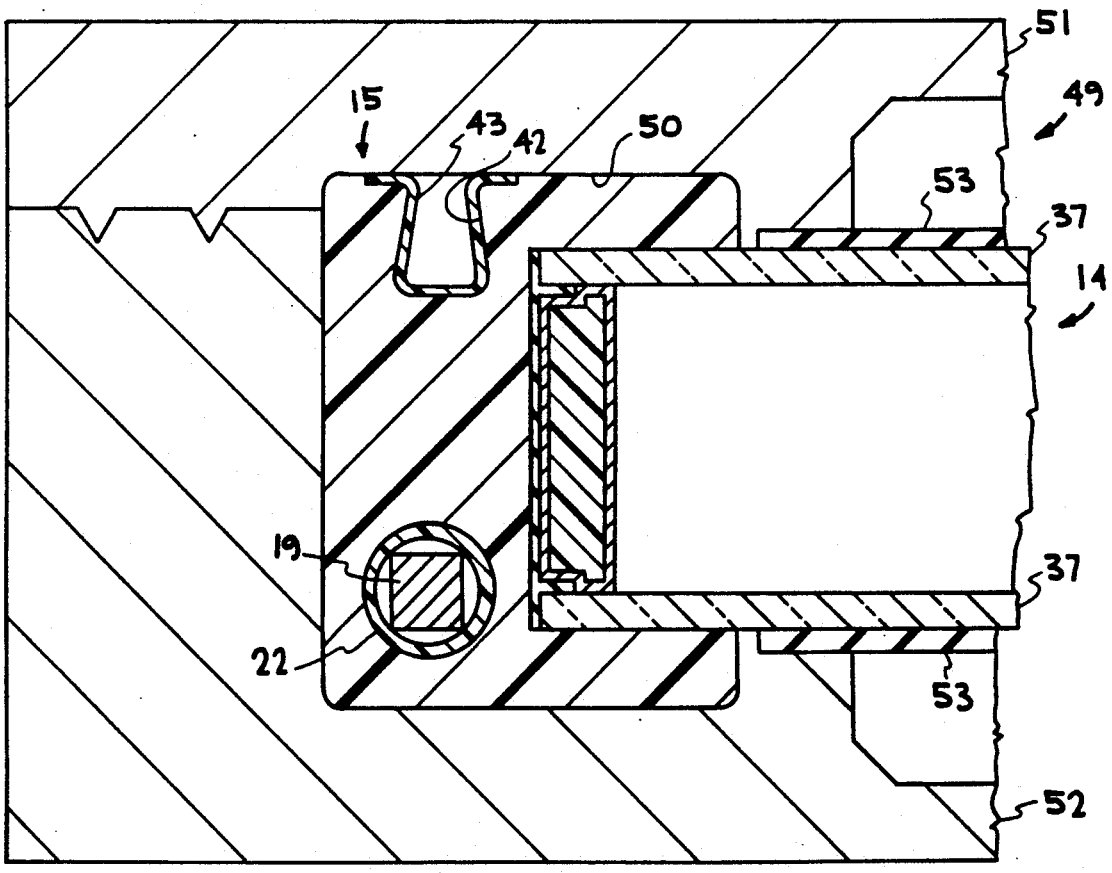
FIG. 5 is a sectional view partially illustrating a two-part mold assembly adapted to structurally integrate the thermo-pane, torsion bar and door frame during an injection molding process.

FIG. 5 partially illustrates a two-part mold assembly 49 utilized for carrying forth the method steps for making structurally integrated refrigerator door assembly 11. The method comprises positioning thermo-pane 14, having sealing strip 38 suitably secured between glass plates 37, within a mold cavity 50, along with hinge pins 16 and 17, torsion bar 19 and covering sheath 22, and elastomeric gasket 43. Elastomeric (rubber) sheets 53 are preferably disposed between glass plates 37 and the mold parts for glass protection purposes. A liquified thermo-plastic or thermo-setting plastic material of a suitable type is then injected into mold cavity 50 in a conventional manner to form door frame 15 in sealing relationship about thermo-pane 14 and to structurally integrate the thermo-pane, hinge pins and torsion bar within the frame. As suggested above, a suitable release agent is coated onto hinge pin 16 prior to the molding process to insure that the pin is allowed to twist within the door frame after it has been allowed to cure and harden.

After the completed refrigerator door subassembly has been completed, magnetic strip and seal assembly 44 is suitably secured within groove 42 about the periphery of the door frame and hinge pins 16 and 17 are mounted in upper and lower hinge brackets 24 and 31, respectively. During installation, lower hinge pin 17 can be adjusted by the selective loosening and tightening of nut 35 (FIG. 2) to ensure vertical orientation of hinge pins 16 and 17. Further, an Allen wrench is applied to socket 26, prior to installation of locking pin 29, to set the desired torsional force on torsion bar 19 in the manner described above.

The plastic material composing molded door frame 15 may be of any suitable type. For example, the plastic material composing the door frame may comprise ABS (three-monomer system composed of acrylonitrile, butadiene and styrene), OSA (olefin-modified styrene-acrylonitrile) acetal copolymer, glass-reinforced high impact acrylic, or other suitable plastic resin material adapted for refrigerator door applications of the type described herein. Although refrigerator door assembly 11 is described as having a thermo-pane 14, it should be understood that it could be formed solid for certain refrigeration applications. Suitable screw-type inserts (not shown) could also be integrally formed within the door frame for subsequent attachment of a standard handle 54 thereon (FIG. 1). The door frame can be permanently colored by adding a standard coloring pigment to the liquified plastic material during the molding process.

I claim:

1. A refrigerator door assembly adapted to be mounted on a stationary frame of a refrigeration unit comprising a thermo-pane, a door frame composed of a molded and solid unitary plastic material and having said thermo-pane mounted and sealed therein by said plastic material, vertically aligned upper and lower hinge means integrally molded within the plastic material composing said door frame for mounting said door assembly for pivotal movement about a common pivot axis on the stationary frame of said refrigeration unit, the plastic material composing said door frame entirely encapsulating and sealing the entire periphery of said thermopane therein torsion means, including a torsion bar having a main body and sheath means at least covering said main body for permitting said main body to twist relative to said sheath means, connected to at least one of said upper and lower hinge means for constantly applying a closing force on said door frame to pivot said door assembly about said common pivot axis, the plastic material composing said door frame encapsulation and integrally securing said sheath means within said door frame to permit the main body of said torsion bar to twist relative to said sheath means and said door frame.

2. The refrigerator door assembly of claim 1 wherein said upper hinge means comprises an upper pin having an upper end projecting beyond an upper end of said door frame and wherein an upper end of said torsion bar is secured to a lower end of said upper pin .

3. The refrigerator door assembly of claim 2 wherein the main body of said torsion bar is disposed on said common pivot axis and a lower end of said torsion bar is bent to provide an anchoring leg disposed transversely relative to said axis and entirely encapsulated within said door frame by said plastic material.

4. The refrigerator door assembly of claim 2 wherein said lower hinge means comprises a lower pin having a lower end projecting beyond a lower end of said door frame.

5. The refrigerator door assembly of claim 1 further comprising adjustment means for selectively setting the magnitude of said closing force.

6. The refrigerator door assembly of claim 1 wherein said thermo-pane comprises a pair of spaced-apart window panes and a sealing strip disposed between and about the periphery of said window panes, said sealing strip being integrally molded within and to the plastic material composing said door frame.

7. The refrigerator door assembly of claim 6 further comprising groove means defined in an inner side of said door frame and magnetic strip and seal means disposed in said groove means for maintaining said door assembly in closed and sealing relationship on the stationary frame of said refrigeration unit.

8. A refrigerator door assembly hingedly mounted on a stationary frame of a refrigeration unit by vertically aligned upper and lower hinge brackets, secured on said frame, for movement between closed and open positions, said door assembly comprising a door frame composed of a molded and solid unitary plastic material, vertically aligned upper and lower hinge pin means integrally molded within the plastic material composing said door frame and mounting said door assembly for pivotal movement about a common pivot axis on said upper and lower hinge brackets, respectively, and torsion means connected to at least one of said upper and lower hinge pin means for constantly applying a closing force on said door frame to pivot said door assembly about said common pivot axis and into sealing relationship against said stationary frame, said torsion means comprising a torsion bar having a main body and sheath means at least covering the main body of said torsion bar and entirely encapsulated within and integrally secured to the plastic material composing said door frame to permit said torsion bar to twist relative to said sheath means and said door frame.

9. The refrigerator door assembly of claim 8 wherein said upper hinge pin means comprises an upper pin having an upper end mounted in said upper hinge bracket and wherein an upper end of said torsion bar is secured to a lower end of said upper pin.

10. The refrigerator door assembly of claim 9 wherein the main body of said torsion bar is disposed on said common pivot axis and a lower end of said torsion bar is bent to provide an anchoring leg disposed transversely relative to said axis and encapsulated within said door frame.

11. The refrigerator door assembly of claim 8 further comprising adjustment means for selectively setting the magnitude of said closing force.

12. The refrigerator door assembly of claim 11 wherein said adjustment means comprises a collar mounted on an upper end of said upper hinge pin means and secured to said upper hinge bracket, means for rotating said upper hinge pin means relative to said collar and means for locking said upper hinge pin means in a selected rotative position relative to said collar.

13. The refrigerator door assembly of claim 8 wherein said lower hinge pin means comprises a lower pin having a lower end projecting beyond a lower end of said door frame, slot means formed through said lower hinge bracket and having the lower end of said lower pin disposed therein and means for securing said lower pin in an adjusted position within said slot means for vertically orientating said common pivot axis.

14. The refrigerator door assembly of claim 8 further comprising a thermo-pane integrally molded in sealing relationship within said door frame, said thermo-pane comprising a pair of spaced-apart window panes and a sealing strip disposed between an about the periphery of said window panes, said sealing strip being integrally molded within said door frame.

15. The refrigerator door assembly of claim 8 further comprising groove means defined in an inner side of said door frame, magnetic strip and seal means disposed in said groove means for maintaining said door assembly in closed and sealed relationship on the stationary frame of said refrigeration unit, and metallic strip means secured to an outer side of said stationary frame for engaging said magnetic strip and seal means when said door assembly is in its closed position.

* * * * *